US010946257B1

(12) United States Patent
McPhee

(10) Patent No.: US 10,946,257 B1
(45) Date of Patent: Mar. 16, 2021

(54) GOLF ACCESSORY FOR DETERMINING GIMME PUTT

(71) Applicant: John McPhee, La Quinta, CA (US)

(72) Inventor: John McPhee, La Quinta, CA (US)

( * ) Notice: Subject to any disclaimer, the term of this patent is extended or adjusted under 35 U.S.C. 154(b) by 0 days.

(21) Appl. No.: 16/580,047

(22) Filed: Sep. 24, 2019

(51) Int. Cl.
*A63B 57/00* (2015.01)

(52) U.S. Cl.
CPC ..... *A63B 57/00* (2013.01); *A63B 2210/50* (2013.01); *A63B 2220/20* (2013.01)

(58) Field of Classification Search
CPC . A63B 57/00; A63B 2220/20; A63B 2210/50; A63B 69/3676; A63B 57/40; A63B 57/505; A63B 57/357
USPC ..... 473/407, 176
See application file for complete search history.

(56) References Cited

U.S. PATENT DOCUMENTS 2,041,119 A * 5/1936 Duganne ..... A63B 57/40 473/176
3,908,991 A * 9/1975 Schwartz ..... A63B 69/3676 473/241
4,273,329 A * 6/1981 Trigg ..... A63B 57/00 473/407
4,532,712 A * 8/1985 Vistain ..... G01B 3/02 33/613
4,880,232 A * 11/1989 Lang ..... A63B 57/40 473/176
5,403,001 A 4/1995 Skorpinski
6,102,817 A * 8/2000 Boswell ..... A63B 57/00 473/407
7,708,658 B2 * 5/2010 McInerney ..... A63B 21/153 473/407
8,317,633 B2 * 11/2012 Maclean ..... A63B 69/3676 473/177
8,647,215 B2 * 2/2014 Falls ..... A63B 57/00 473/257
8,657,699 B2 * 2/2014 Falls ..... A63B 57/00 473/257
8,801,546 B2 * 8/2014 Roark ..... A63B 67/068 33/759
2009/0318247 A1 * 12/2009 Cannata ..... A63B 69/3685 473/407
2019/0070479 A1 * 3/2019 Elzinga ..... A63B 69/3676

* cited by examiner

*Primary Examiner* — Steven B Wong
(74) *Attorney, Agent, or Firm* — Sanchelima & Associates, P.A.; Christian Sanchelima; Jesus Sanchelima

(57) ABSTRACT

A golf accessory for determining a gimme putt distance is disclosed. The golf accessory comprises a handle with a trigger, a telescoping rod mounted to the trigger including a length adjustment configuration, a hinge mechanism mounted to the telescoping rod and a base mounted to the hinge mechanism. The hinge mechanism is configured to allow the telescoping rod to fall horizontally on a ground surface upon activation of the trigger to determine a gimme distance in a golf game. The gimme is determined as positive if the telescoping rod covers a ball marker on the ground surface. The gimme is determined as negative if the telescoping rod fails to cover a ball marker on the ground surface.

10 Claims, 4 Drawing Sheets

GOLF ACCESSORY FOR DETERMINING GIMME PUTT

BACKGROUND OF THE INVENTION

1. Field of the Invention

The present disclosure relates to a golf accessory. More particularly, the present disclosure relates to a golf accessory for determining the gimme putt distance.

2. Description of the Related Art

In golf, a gimme is a shot that the other players agree to count automatically without being played. Meaning one stroke is counted and there is no need to play the ball. Most commonly gimme is used in recreational rounds of golf or other rounds among friends. One arbitrary gauge of conceding a putt occurs when the distance between the ball lying on the green and the hole is within "the leather" or the length of the putter handle. However, most golfers who play with gimme don't actually measure "inside the leather," they just approximately eyesight the ball and putt length. Which makes it easy for the length of gimme to keep creeping upward, so that what a golfer claims as a gimme gets longer and longer as the round goes on. In that way, gimme putts could become crutches relied on by poor putters who don't have the confidence to putt out the short ones. The gimme putt being eyeballed can also result in a player using longer gimme putt distances to gain an unfair advantage against their opponents.

Several devices have been designed in the past. None of them, however, include an efficient golf accessory for determining gimme putt that is capable of addressing the foregoing discussed issues. Further, none include a tool for measuring the distance of a golf ball from the hole on a putting green to determine if a putt can be conceded if it's close enough to the hole comprising a folding telescopic stick which is inserted into the golf cup and folded down and extended out to the determined range in which a putt can be conceded.

Applicant believes that a related reference corresponds to U.S. Pat. No. 4,532,712 filed by James E. Vistain describes a proximity measuring device for golfers. The Vistain reference discloses a proximity comparing device for determining relative distances of golf balls from a flagstick. The device includes a clamping ring to releasably engage the flagstick while permitting sliding movement of the clamping ring about the periphery of the flagstick in combination with a string. One end of the string is anchored to the clamping ring and another end is received in a reel. An adjustable amount of string is played out or received in the reel to determine promptly which of two golf balls is farthest from the flagstick. However, the Vistain reference comprises a complex structure and requires a repetitive manual process for each putt requiring determination of gimme.

Another related reference is U.S. Pat. No. 5,403,001 filed by Frank J. Skorpinski describes a golf putting aid device and chart. The Skorpinski reference discloses a putting aid device for aiding a golfer in reading a putting green by measuring the direction and amount of slope in a green and indicating to the golfer a putting variance factor for a particular ball relative to a ball hole. The putting variance factor corresponds to the distance from a reference putting line to an off-set target point. The putting aid device includes an elongated housing, an elongated bubble vial, and a putting variance scale calibrated with respect to the bubble vial. In use, the putting aid device is selectively positioned on a reference putting line and indicates an off-set target distance. The putting aid device is configured to produce a putting variance chart of the conditions of a green. However, the Skorpinski reference includes a complex method for determination of gimme.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a golf accessory for determining gimme distance in a golf game.

It is another object of the present invention to provide a golf accessory for automatically and accurately determining gimme distance in the golf game.

It is yet another object of the present invention to provide a golf accessory to increase the enjoyment in golf rounds and decrease social awkwardness, arguments, assumptions, entitlements and guilt that accompanies discretionary determination of gimme distance without a standardized device to instead promote friendship, mutual agreement, fairness and consistency.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
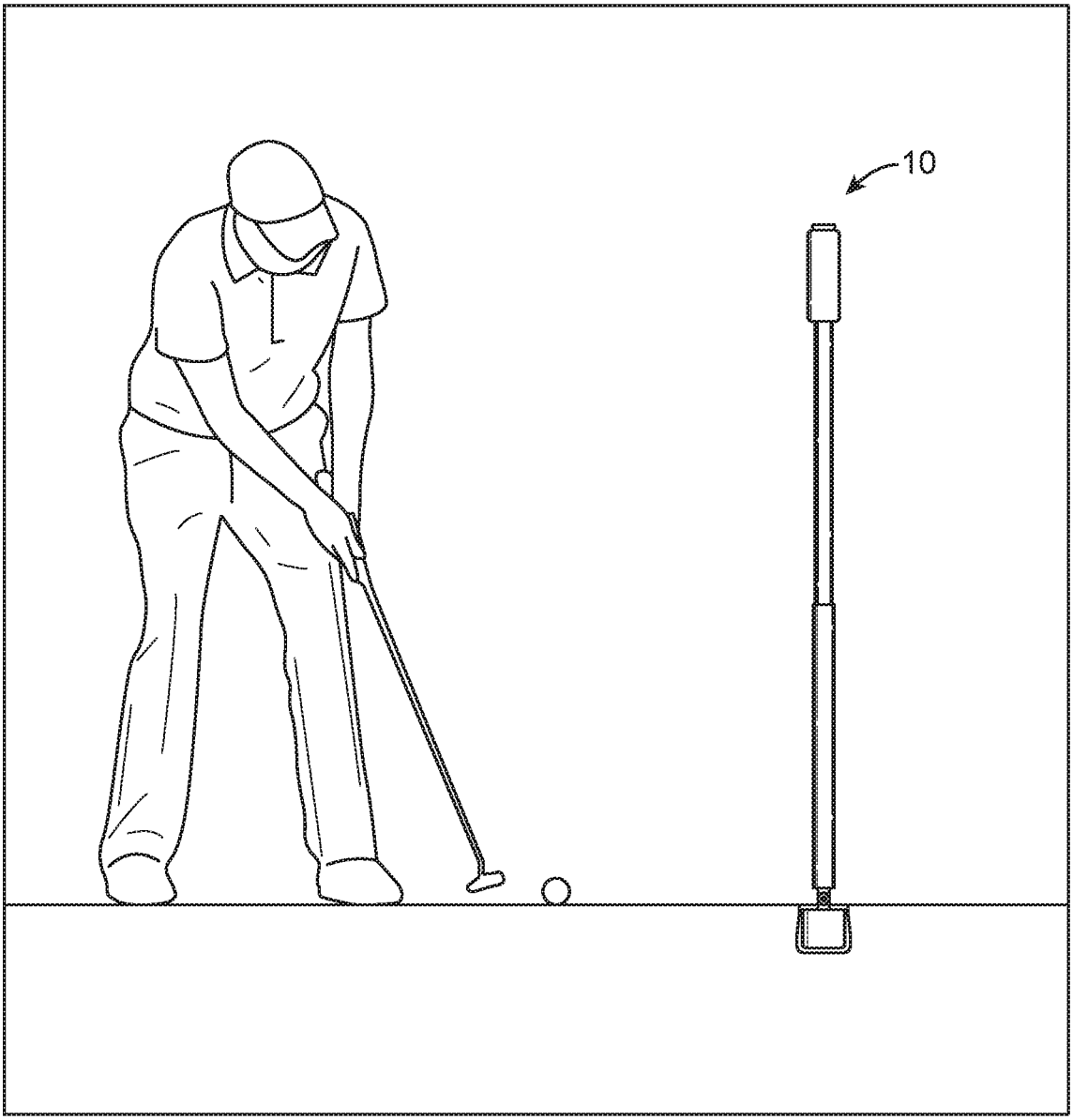
FIG. 1 exemplarily illustrates a golf accessory 10 disposed in a golf cup to determine the gimme distance in a golf game according to an embodiment of the present invention.
Figure 2:
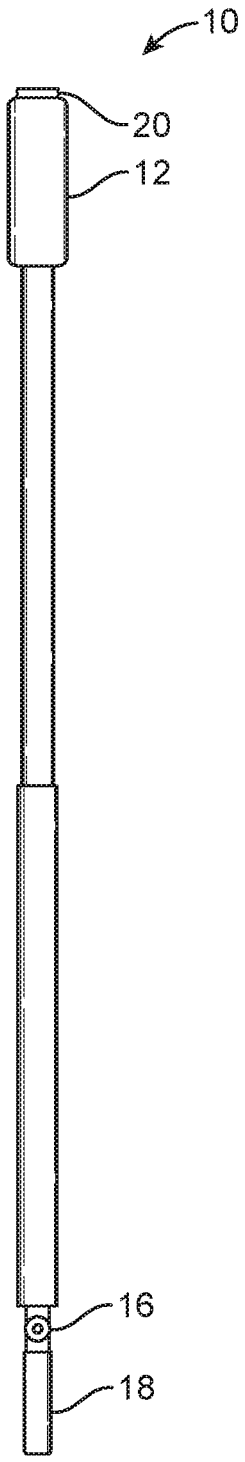
FIG. 2 exemplarily illustrates a side view of the golf accessory 10 according to an embodiment of the present invention. The golf accessory 10 comprising a handle 12, a telescoping rod 14, a hinge mechanism 16, a base 18 and a trigger 20 is illustrated.
Figure 3:
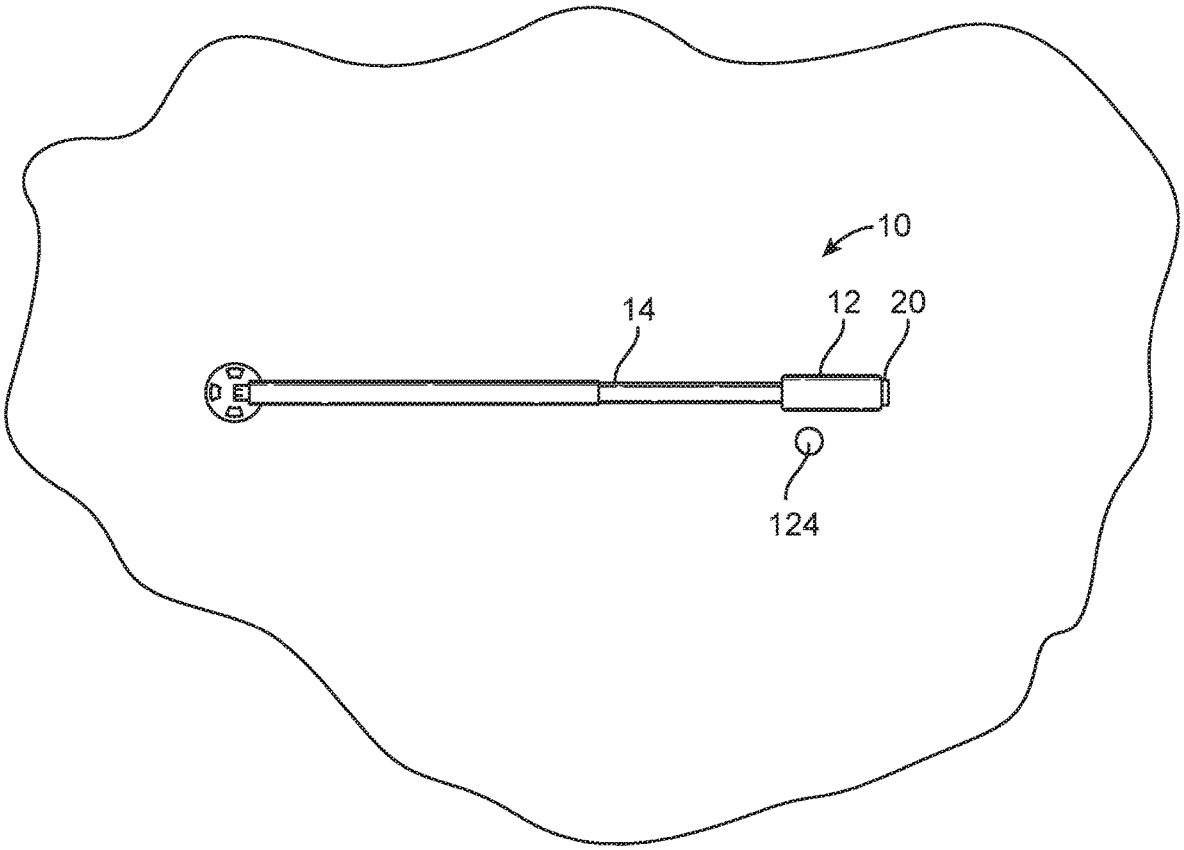
FIG. 3 exemplarily illustrates the golf accessory 10 being utilized to determine gimme distance in the golf game according to an embodiment of the present invention.

Referring now to the drawings, FIGS. 1-5, where the present invention is generally referred with numeral 10, it can be observed that a golf accessory 10 for determining a gimme distance in a golf game is disclosed.

The golf accessory 10 comprises a handle 12 with a trigger 20, a telescoping rod 14 mounted to the trigger 20, a hinge mechanism 16 mounted to the telescoping rod 14 and a base 18 mounted to the hinge mechanism 16.

In one embodiment, the handle 12 comprises an interior cavity housing the trigger 20. In one embodiment, the trigger 20 may be a spring-based trigger. The telescoping rod 14 is mounted to the housing by locking elements that allow to extend, retract, or adjust the length of the handle 12 within the contemplation of the invention. In another embodiment, the handle 12 also comprises a housing formed of a material selected from a group including, but not limited to, rubber, leather, or plastic material suitable for gripping purpose.

The telescoping rod 14 mounted to the trigger 20 is configured to enable adjustment of length of the telescoping rod 14. In one embodiment, the telescoping rod 14 comprises at least two portions i.e., an outer tube and an inner tube, the diameter of the outer tube is greater than the diameter of the inner tube. In one embodiment, the two tubes are slidably locked in position by one or more locking members. In another embodiment, the tube sections are in the form of circular hollow tube. In yet another embodiment, the tube sections are formed with complementary non-circular structure. In one embodiment, the locking member configured to lock the tubes in position after adjustment of the length of the telescoping rod 14. In one embodiment, the telescoping rod 14 is made of a material selected from the group, including, but not limited to, hard plastic and light steel.

The hinge mechanism 16 mounted to the telescoping rod 14 is configured to allow the telescoping rod 14 to fall horizontally on a ground surface on activation of the trigger 20 to determine a gimme distance in a golf game. In one embodiment, the telescoping rod 14 could be set a length in range of 12 to 30 inches. The hinge mechanism 16 is configured to lock or unlock the telescoping rod 14 and enables to pivot into desired relative orientation. In one embodiment, the hinge mechanism 16 could be made of molded plastic, or of metal, or other suitable materials known or used by those skilled in the arts. Similarly, one or more hinging and locking features could be employed as known or can be devised by those skilled in the art. In one embodiment, the telescoping rod 14 may include indicia such as measurements or quotes such as "a measure of friendship".

The base 18 mounted to the hinge mechanism 16 is configured to rest on a golf hole. In one embodiment, the base 18 is adapted to be placed within the golf cup and hold the golf accessory 10 vertically when the hinge mechanism 16 locks the telescoping rod 14. In one embodiment, the base 18 is cylindrical in structure. In another embodiment, the base 18 includes any characteristic shape suitable to hold the golf accessory 10 in place. In yet another embodiment, the golf accessory 10 is made of a rigid material selected from a group including, but not limited to, steel or metal.

In one embodiment, the working of the golf accessory 10 is disclosed. Initially, the length of the telescoping rod 14 is set to a desired length, for example, 24 inches, prior to the start of play. When a player's ball lands close enough to the golf hole, the golf accessory 10 is placed in the golf cup. Then, the telescoping rod 14 is released with the trigger 20, which would proceed to fall down on the ground surface. If the telescoping rod 14 cover the ground surface or hits the ball marker or golf ball placed in the ball marker of the golf putt, the gimme is determined as positive and a gimme is awarded to the player. If the telescoping rod 14 falls short of the ball, the player returns their ball to the ball marker and continues their play.

Figure 4:
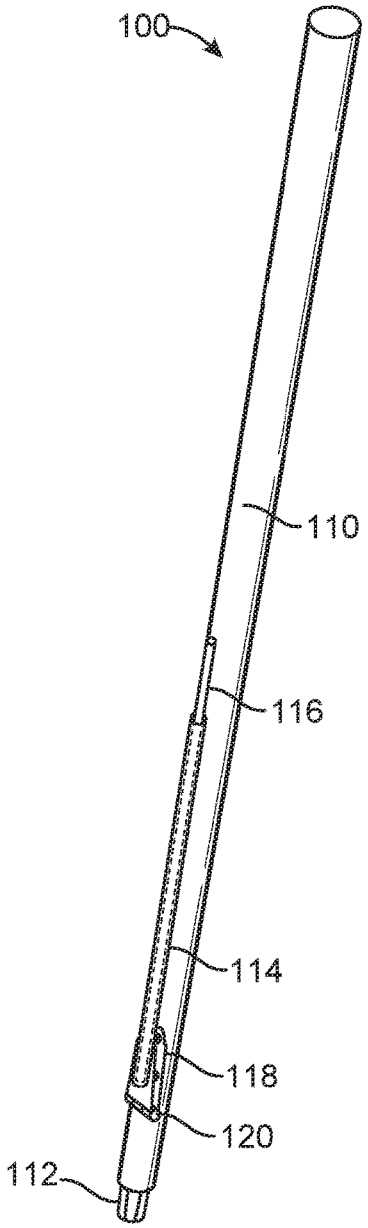
FIG. 4 is an alternate embodiment of the present invention in a closed configuration.
Figure 5:
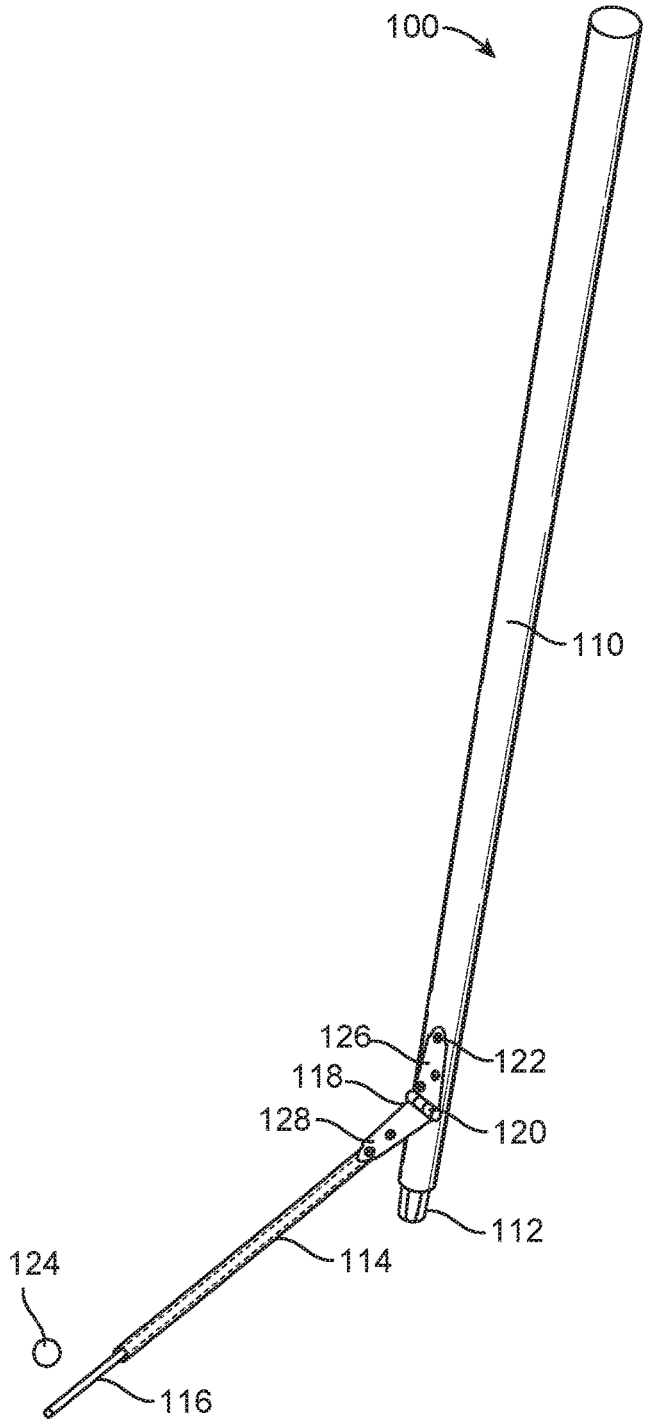
FIG. 5 is an alternate embodiment of the present invention in an opened configuration.

An alternate embodiment, a golf accessory 100 of the present invention can be seen in FIGS. 4-5. Golf accessory 100 may include a rod 110 of a predetermined shape and dimension. Rod 110 may be inserted into golf holes with the use of a hole base 112 located at a distal end of rod 110. Hole base 112 is of a predetermined dimension and shape that cooperates with being received in golf holes to have the present invention erected upwardly. Mounted thereon rod 110 may be a rod holder 114. Rod holder 114 may be hollow and have an open end on the top. Rod holder 114 may be elongated and cylindrical shaped. It should be understood that rod holder 114 may be adapted to receive and secure a distance rod 116 therein. Distance rod is inserted through the open end of rod holder 114. Distance rod 116 may be substantially housed within rod holder 114. Distance rod 116 may be secured inside of rod holder 114 with the use of magnets or other means may be suitable. It may be suitable to use fasteners, snap buttons, hook and loop straps or the like instead of magnets. These aforementioned means may be mounted to an end of distance rod 16 that is housed within rod holder 114. Distance rod 116 may come in a variety of predetermine dimensions and lengths. The various length of distance rod 116 may be predetermined based on the rules and how much of a gimme distance is deemed appropriate before the game of golf is began. Rod holder 114 is hindgedly mounted to rod 110 with a hinge 118. Hinge 118 may be made of a first portion 126 and a second portion 128. First part 126 being directly mounted to rod 110. Hinge 118 may be capable of moving rod holder 114 and distance rod 116 to a raised and lowered position. Rod holder 114 is manually moved to a lowered position with distance rod 116 therein to determine if a golf ball 124 falls within the predefined gimme distance. In the lowered position, distance rod 116 is laid horizontally on a ground surface. Rod holder 114 and distance rod 116 may be manually moved to achieve the raised position when there is no need to use the present invention. Hinge 118 may rotate a predetermined amount about a fixed point 120. Hinge 118 may be mounted to rod 110 with the use of fasteners 122. It should be understood that the present invention may include at least one of distance rod 116, there can be multiple of distance rod 116 in order to allow for different gimme distances to be used in different games with different opponents with the present invention.

Advantageously, the golf accessory 10 allows to determine whether a putt is relatively close to the hole that could be interpreted by the player, a fellow competitor or by other members of the group as a concession of the next stroke. The gimme stick is configured to define an exact desired length of all putts that would be conceded during a round of golf and eliminate any arguments caused due to the determination of gimme distance. The golf accessory 10 could be used for recreational, social golf activities, and by any individual, country clubs or golf leagues need to determine a gimme distance in the golf game.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a golf accessory, comprising:

a golf ball;

a handle;

a trigger mounted to said handle, said trigger being mounted atop of said handle, said trigger being entirely above of said handle;

a telescoping rod mounted to said handle, said telescoping rod being entirely and constantly below said handle, said handle being in constant abutting contact with said telescoping rod;

a hinge mechanism mounted to said telescoping rod, said hinge mechanism being entirely beneath of said telescoping rod, said hinge mechanism configured to allow said telescoping rod to fall horizontally on a ground surface when said trigger is actuated to determine a gimme distance, said gimme distance achieved when said telescoping rod falls adjacently to said golf ball on said ground surface; and a base mounted to said hinge mechanism configured to rest in a golf hole; said trigger, said handle, said telescoping rod, and said hinge mechanism constantly being on a same plane.

2. The system of claim 1, wherein the gimme distance is negative when said telescoping rod fails to cover a ball marker on said ground surface.

3. The system of claim 1, wherein the gimme distance is positive when said telescoping rod covers a ball marker on the ground surface.

4. The system of claim 1, wherein said trigger is a spring based-trigger.

5. The system of claim 1, wherein said handle includes a plastic housing.

6. The system of claim 1, wherein said base is made of steel.

7. The system of claim 1, wherein said telescopic rod is made of at least one of a plastic or steel material.

8. The system of claim 1, wherein said telescoping rod includes at least two portions connected telescopically.

9. The system of claim 8, wherein said at least two portions are further defined as an inner tube and an outer tube.

10. The system of claim 9, wherein said outer tube has a diameter greater than that of said inner tube, said inner tube and said outer tube being hollow.

* * * * *